US006862743B2

(12) United States Patent
Friedman

(10) Patent No.: US 6,862,743 B2
(45) Date of Patent: Mar. 8, 2005

(54) KNITTED COLLAR WITH STAYS AND METHOD OF MANUFACTURING SUCH A COLLAR

(76) Inventor: Marc Friedman, 10820 NW. 12th Pl., Plantation, FL (US) 33322

( * ) Notice: Subject to any disclaimer, the term of this patent is extended or adjusted under 35 U.S.C. 154(b) by 289 days.

(21) Appl. No.: 10/236,894

(22) Filed: Sep. 6, 2002

(65) Prior Publication Data

US 2003/0140394 A1 Jul. 31, 2003

Related U.S. Application Data

(63) Continuation-in-part of application No. 10/058,204, filed on Jan. 29, 2002, now Pat. No. 6,708,344.

(51) Int. Cl.[7] ..... A41B 3/00
(52) U.S. Cl. ..... 2/132
(58) Field of Search ..... 2/129, 255, 256, 2/137, 130–132, 175.4, 195.5, 116; 223/52, 94, 52.1, 84; 156/160, 293, 494; 66/170, 171, 172 R

(56) References Cited

U.S. PATENT DOCUMENTS 3,286,278 A 11/1966 O'Connor
3,832,737 A 9/1974 Podosky
4,038,840 A 8/1977 Castello
4,286,337 A 9/1981 Malouf, Jr.
6,167,732 B1 1/2001 Friedman

*Primary Examiner*—Tejash Patel
(74) *Attorney, Agent, or Firm*—Laurence A. Greenberg; Werner H. Stemer; Gregory L. Mayback

(57) ABSTRACT

A knitted collar for a shirt and a method for manufacturing such a collar. The collar includes a knitted collar body having a sewing edge adapted to be attached to the shirt, a finished edge and two selvedges. The body has a pocket at each of the two selvedges. The pocket has first and second ends extending approximately from the finished edge to the sewing edge. The pocket is closed at the first end by the finished edge. A stay is disposed in the pocket of each of the two selvedges. The stay has a first end facing the first end of the pocket and a second end facing the second end of the pocket. A stop stitch formed between the first and second ends of the pocket. The stop stitch closes one of the first and second ends of the pocket for substantially preventing the stay from moving within the pocket. A new type of stay with protrusions is also described.

26 Claims, 2 Drawing Sheets

KNITTED COLLAR WITH STAYS AND METHOD OF MANUFACTURING SUCH A COLLAR

CROSS-REFERENCE TO RELATED APPLICATION

This application is a continuation-in-part of U.S. patent application Ser. No. 10/058,204, filed Jan. 29, 2002 now U.S. Pat. No. 6,708,344.

BACKGROUND OF THE INVENTION

Field of the Invention

The invention relates to a knitted collar with stays and a method of manufacturing such a collar.

It is desirable to wear an open collar shirt of knitted fabric material at different times because it is particularly comfortable to wear. However, the somewhat casual appearance afforded by it restricts its use on occasions when a somewhat neater appearance is desired. One reason for this is the collar, which by virtue of being made of knitted fabric, tends to wrinkle and does not look neat.

U.S. Pat. No. 3,286,278 to T. R. O'Connor addresses this problem and proposes as a solution inserting plastic stays in cooperating pockets located at the edges of the collar which bound the front neck opening of the shirt. Using stay techniques, as also exemplified by U.S. Pat. No. 4,286,337 to Malouf, Jr., the knitted collar is knitted with pockets having end openings through which the plastic stays are inserted and, after which, are stitched closed.

One problem of the prior art is that the stay tends to move in the pocket, because it is shorter than the pocket. The reason for the stay to be shorter than the pocket is to allow for the natural curve of the collar.

Another problem of the prior art is that the stay cannot be removed once it is closed in the pocket. Sometimes it is desirable to remove the stay before cleaning/washing the shirt at a temperature that distorts the shape of the plastic stay.

SUMMARY OF THE INVENTION

It is accordingly an object of the invention to provide a knitted collar with stays that overcomes the hereinaforementioned disadvantages of the heretofore-known devices and a method of manufacturing such a collar.

More particularly, it is an object of the invention to provide a stop stitch adjacent an end of the stay to prevent the stay from moving in the pocket.

It is another object of the invention to provide a side opening at the pocket to facilitate the removal and reinsertion of the stay from and into the pocket.

It is still another object of the invention to provide a stay with one or more protrusions on one or both sides thereof to prevent the stay from moving in the pocket.

With the foregoing and other objects in view, there is provided, in accordance with the invention, a knitted collar for a shirt, including a knitted collar body having a sewing edge adapted to be attached to the shirt, a finished edge, and two selvedges; the body having a pocket at each of the two selvedges, the pocket having first and second ends extending approximately from the finished edge to the sewing edge, and the pocket being closed at the first end by the finished edge; a stay disposed in the pocket of each of the two selvedges, the stay having a first end facing the first end of the pocket, and a second end facing the second end of the pocket; and a stop stitch formed between the first and second ends of the pocket, the stop stitch closing one of the first and second ends of the pocket for substantially preventing the stay from moving within the pocket.

In accordance with another feature of the invention, the stop stitch closes the second end of the pocket adjacent the sewing edge and a further stop stitch formed is adjacent the finished edge for substantially preventing the stay from protruding through the finished edge.

In accordance with a further feature of the invention, there is provided a side opening formed at each of the two selvedges for inserting the stay into the pocket or removing the stay out of the pocket.

In accordance with an added feature of the invention, the stay has at least one side and the stay has a protrusion on the at least one side.

In accordance with an additional feature of the invention, the knitted collar is substantially rectangular and the finished edge is opposite the sewing edge In accordance with yet another feature of the invention, the first end of the stay approximately reaches the first end of the pocket.

In accordance with yet a further feature of the invention, the stop stitch forms the second end of the pocket.

In accordance with yet an added feature of the invention, the second end of the pocket is opposite the first end of the pocket.

In accordance with yet an additional feature of the invention, the further stop stitch extends along the finished edge.

In accordance with again another feature of the invention, the further stop stitch extends parallel to the finished edge.

With the objects of the invention in view, there is also provided a knitted collar for a shirt, including a knitted collar body having a sewing edge adapted to be attached to the shirt, a finished edge, and two selvedges; the body having a pocket at each of the two selvedges for receiving a stay, the pocket having first and second ends extending approximately from the finished edge to the sewing edge, and the pocket being closed at the first end by the finished edge; and a stop stitch formed between the first and second ends of the pocket, the stop stitch closing one of the first and second ends of the pocket for substantially preventing the stay from moving within the pocket.

With the objects of the invention in view, there is also provided a knitted collar for a shirt, including a knitted collar body having a sewing edge adapted to be attached to the shirt, a finished edge, and two selvedges; the body having a pocket at each of the two selvedges, the pocket having two ends, extending approximately from the finished edge to the sewing edge, and being closed at one of the two ends by the finished edge; and a stay disposed in the pocket, the stay having at least one side and at least a protrusion formed on the at least one side, the protrusion substantially preventing the stay from moving in the pocket.

With the objects of the invention in view, there is also provided in combination with a knitted collar for a shirt, a stay including a stay body having at least one side and at least one protrusion formed on the at least one side of the stay.

In accordance with another feature of the invention, the at least one protrusion is selected from the group consisting of a hook, a triangle shaped protrusion, a fin-shaped protrusion, and a button-shaped protrusion.

With the objects of the invention in view, there is also provided a shirt, including a shirt body, and a knitted collar having: a knitted collar body having a sewing edge attached to the shirt body, a finished edge, and two selvedges; the collar body having a pocket at each of the two selvedges, the pocket having first and second ends extending approximately from the finished edge to the sewing edge, and the pocket being closed at the first end by the finished edge; a stay disposed in the pocket of each of the two selvedges, the stay having a first end facing the first end of the pocket, and a second end facing the second end of the pocket; and a stop stitch formed between the first and second ends of the pocket, the stop stitch closing one of the first and second ends of the pocket for substantially preventing the stay from moving within the pocket.

With the objects of the invention in view, there is also provided a shirt, including a shirt body, and a knitted collar having: a knitted collar body having a sewing edge attached to the shirt body; a finished edge, and two selvedges; the collar body having a pocket at each of the two selvedges for receiving a stay, the pocket having first and second ends extending approximately from the finished edge to the sewing edge, and the pocket being closed at the first end by the finished edge; and a stop stitch formed between the first and second ends of the pocket, the stop stitch closing one of the first and second ends of the pocket for substantially preventing the stay from moving within the pocket.

With the objects of the invention in view, there is also provided a shirt, including a shirt body, and a knitted collar having: a knitted collar body having a sewing edge attached to the shirt body, a finished edge, and two selvedges; the collar body having a pocket at each of the two selvedges, the pocket having two ends, extending approximately from the finished edge to the sewing edge, and being closed at one of the two ends by the finished edge; and a stay disposed in the pocket, the stay having at least one side and at least a protrusion formed on the at least one side, the protrusion substantially preventing the stay from moving in the pocket.

With the objects of the invention in view, there is also provided a method for manufacturing a knitted collar, including the steps of knitting a collar body having a sewing edge, a finished edge, and two selvedges; forming a pocket with a bottom closed by the finished edge at each of the two selvedges during knitting; inserting a stay in the pocket towards the bottom of the pocket; and forming a stop stitch between the finished edge and the sewing edge.

In accordance with another mode of the invention, the stop stitch is formed between the stay and the sewing edge In accordance with a further mode of the invention, the stop stitch is formed through the stay.

In accordance with an added mode of the invention, the stop stitch is formed to close the pocket just after the collar body has been knitted to a length approximately equal to a length of the stay.

In accordance with an additional mode of the invention, a further stop stitch is formed adjacent the finished edge to substantially prevent the stay from protruding through the finished edge.

In accordance with yet another mode of the invention, a side opening is formed at each of the selvedges for inserting the stay into the pocket or removing the stay out of the pocket.

With the objects of the invention in view, there is also provided a method for manufacturing a knitted collar, including the following steps: knitting a collar body having a sewing edge, a finished edge, and two selvedges; forming a pocket with a bottom closed by the finished edge at each of the two selvedges during knitting; providing a stay having at least one side and at least one protrusion formed on the at least one side; and inserting the stay in the pocket towards the bottom of the pocket.

Other features that are considered as characteristic for the invention are set forth in the appended claims.

Although the invention is illustrated and described herein as embodied in a knitted collar with stays and a method of manufacturing such a collar, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIGS. 5–8 are diagrammatic illustrations of a stay with a protrusion at one or both sides thereof, wherein FIG. 5 shows a hook at one end of the stay, FIG. 6 shows triangle shaped protrusions, FIG. 7 shows fin-shaped protrusions, and FIG. 8 shows button-shaped protrusions.

DESCRIPTION OF THE PREFERRED EMBODIMENTS

Figure 1:
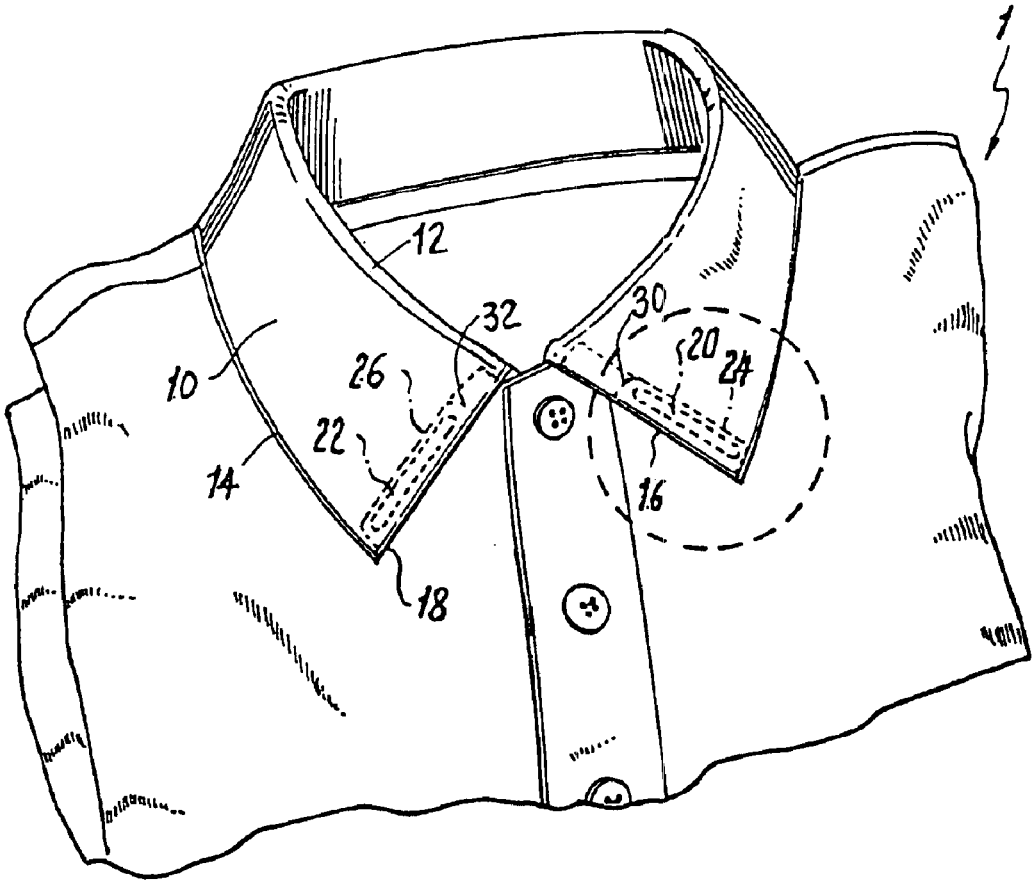
FIG. 1 is a fragmentary, perspective view of a shirt having a knitted collar with stays in the pockets formed at the selvedges of the collar according to the invention.

In all the figures of the drawing, sub-features and integral parts that correspond to one another bear the same reference symbol in each case. Referring now to the figures of the drawing in detail and first, particularly, to FIG. 1 thereof, there is seen a partial perspective view of a shirt (whether knitted or otherwise), as generally designated 1, which has a knitted collar 10. The collar 10 has a sewing edge 12 to be attached to the shirt 1 by sewing, a finished edge 14, and two selvedges 16, 18 bounding the neck opening of the collar 10. The knitted collar 10 is substantially rectangular with substantially parallel sewing and finished edges 12, 14 and substantially parallel selvedges 16, 18.

At each selvedge 16, 18 there is formed a pocket 24, 26 substantially extending from the finished edge 14 to the sewing edge 12, within which stays 20, 22 can be inserted. To prevent the stay 20, 22 from moving within the pocket 24, 26, according to the invention, a stop stitch 30, 32, 50 can be provided, which will be described in more detail with reference to FIGS. 2 and 4.

Figure 2:
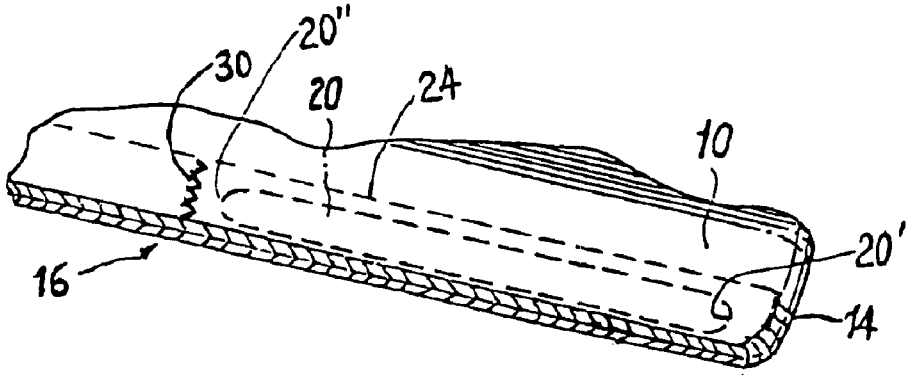
FIG. 2 is a fragmentary, perspective view, on an enlarged scale along the dotted circle of FIG. 1, of a pocket with stay showing an embodiment of a stop stitch according to the invention.

As shown in FIG. 2, the stay 20 can be inserted in the pocket 24 during the knitting process automatically or manually from a non-illustrated top opening of the pocket 24 (disposed approximately at the sewing edge 12) with one end 20' of the stay 20 extending towards and approximately reaching the finished edge 14 of the collar 10. To prevent movement of the stay 20 within the pocket 24, a stop stitch 30 is formed adjacent the other end 20" of the stay 20. The stop stitch 30 can be formed in any conventional way, such as by automated straight knitting (i.e., not making the pocket), hand sewing, or melting of nylon. It is preferable if space is left between the end 20" of the stay 20 and the stop stitch 30 to compensate for any shrinkage of the knitted collar after washing. Preferably, the stop stitch 30 is substantially parallel to the finished edge 14 and the sewing edge 12, however, the stitch 30 can be oriented in other ways. The stop stitch should be formed with strength enough to avoid being penetrated through by the end 20" of the stay 20.

Figure 3:
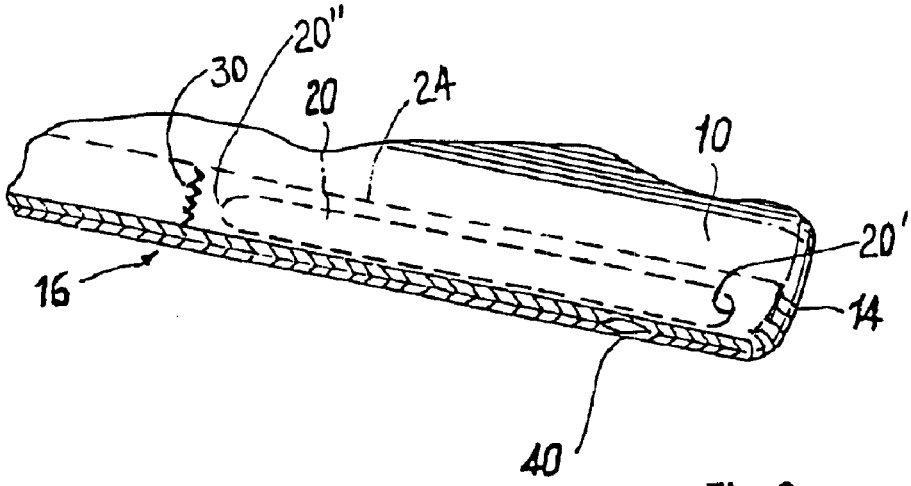
FIG. 3 is a fragmentary, perspective view, similar to FIG. 2, of a pocket with stay showing an embodiment of a side opening according to the invention.

FIG. 3, a view similar to FIG. 2, shows a side opening 40 formed in a seam at the selvedge 16. The stitches of the seam are not employed at the side opening 40 during the knitting process. The side opening is disposed at a suitable location to facilitate the removal and re-insertion of the stay from and into the pocket. The size and location of the side opening should be chosen to guarantee that the stay would not slip out by accident.

Figure 4:
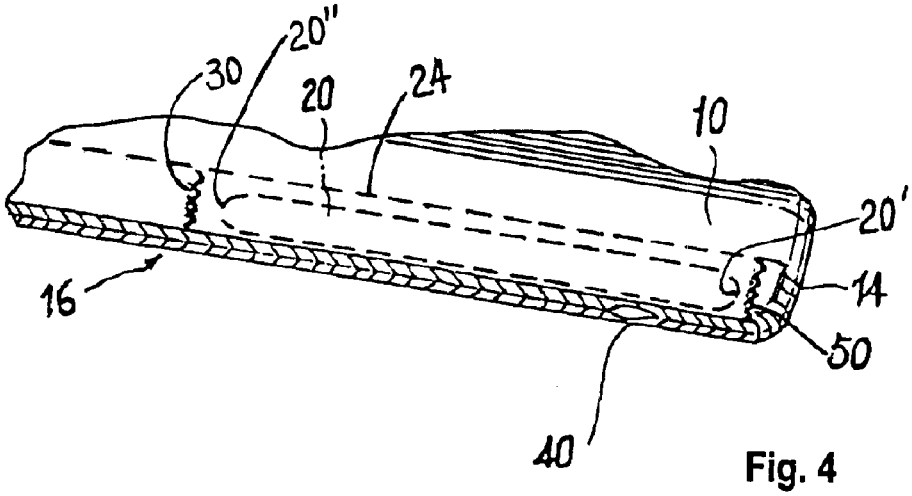
FIG. 4 is a fragmentary, perspective view, similar to FIG. 2, showing a further stop stitch adjacent the finished edge according to the invention.
Figure 5:
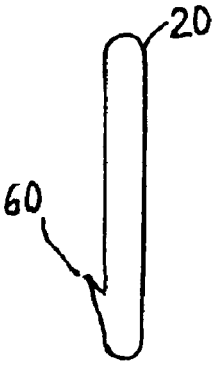
Figure 6:
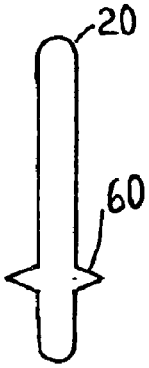
Figure 7:
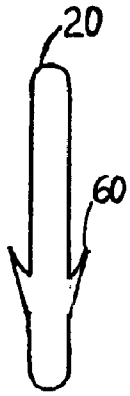

As can be seen from FIG. 4, a view similar to FIG. 2, a different and/or another stop stitch 50 can be optionally formed adjacent the finished edge 14 of the pocket 10 to prevent protrusion or exit of the stay 20 through the finished edge 14. The stop stitch 50 extends along or parallel to the finished edge 14.

FIGS. 5–8 show, schematically, a stay 20 with a protrusion 60 at one or both sides thereof. The purpose of the protrusion is also to prevent the stay from moving in the pocket. By using a stay with protrusion(s), the stop stitch may, therefore, be omitted.

Figure 8:
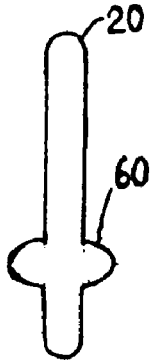

The protrusion can be of numerous different shapes, such as a hook at one end of the stay (see FIG. 5), a triangle shaped protrusion (FIG. 6), a fin-shaped protrusion (FIG. 7) or a button-shaped protrusion (FIG. 8). The protrusion can be formed on one side or both sides of the stay. Each side of the stay can have one or more protrusions.

The method for manufacturing a knitted collar as disclosed above will be described in detail in the following text. First, a collar body 10 having a sewing edge 12, a finished edge 14 and two selvedges 16, 18 is knitted. During the knitting process, a pocket 24, 26 is formed at each of the two selvedges 16, 18 with a bottom closed by the finished edge 14. A stay 20, 22 is inserted in the pocket 24, 26 towards the bottom of the pocket from a top opening of the pocket during the knitting process at a time when the pocket 24, 26 has enough length to hold the stay 20, 22. The insertion of the stay 20, 22 can be automated by the machine or be done by hand. After the pocket is knitted to a length approximately equal to or slightly greater than the length of the stay 20, 22, a stop stitch 30, 32 is formed. The stop stitch 30, 32 can be knitted by the machine automatically through preprogramming of the machine or simply sewed by hand or formed by melted nylon. Optionally, as shown in FIG. 4, a different and/or another stop stitch 50 can be formed adjacent the finished edge 14 by the same method as described above to prevent the stay 20, 22 from protruding from the finished edge 14. A side opening 40 can be formed by not employing stitches at a portion of the selvedges 16, 18 at each pocket 24, 26.

Other embodiments of the invention will be apparent to those skilled in the art from consideration of the specification and practice of the invention disclosed herein. It is intended that the specification and examples be considered as exemplary only and that the invention be only defined in the appended claims.

I claim:

1. A knitted collar for a shirt, comprising:

a knitted collar body having:

a sewing edge adapted to be attached to the shirt;

a finished edge; and two selvedges;

said body having a pocket at each of said two selvedges, said pocket having first and second ends and extending approximately from said finished edge to said sewing edge, and said pocket being closed at said first end by said finished edge;

a stay disposed in said pocket of each of said two selvedges, said stay having:

a first end facing said first end of said pocket; and a second end facing said second end of said pocket; and a stop stitch formed between said first and second ends of said pocket, said stop stitch closing one of said first and second ends of said pocket for substantially preventing said stay from moving within said pocket.

2. The collar according to claim 1, wherein:

said stop stitch closes said second end of said pocket adjacent said sewing edge; and a further stop stitch is formed adjacent said finished edge for substantially preventing said stay from protruding through said finished edge.

3. The collar according to claim 1, including a side opening formed at each of said two selvedges for inserting said stay into said pocket or removing said stay from said pocket.

4. The collar according to claim 1, wherein:

said stay has at least one side; and said stay has a protrusion on said at least one side.

5. The collar according to claim 1, wherein:

said knitted collar is substantially rectangular; and said finished edge is opposite said sewing edge.

6. The collar according to claim 1, wherein said first end of said stay approximately reaches said first end of said pocket.

7. The collar according to claim 1, wherein said stop stitch forms said second end of said pocket.

8. The collar according to claim 7, wherein said second end of said pocket is opposite said first end of said pocket.

9. The collar according to claim 2, wherein said further stop stitch extends along said finished edge.

10. The collar according to claim 2, wherein said further stop stitch extends parallel to said finished edge.

11. A knitted collar for a shirt, comprising:

a knitted collar body having:

a sewing edge adapted to be attached to the shirt;

a finished edge; and two selvedges;

said body having a pocket at each of said two selvedges for receiving a stay, said pocket having first and second ends and extending approximately from said finished edge to said sewing edge, and said pocket being closed at said first end by said finished edge; and a stop stitch formed between said first and second ends of said pocket, said stop stitch closing one of said first and second ends of said pocket for substantially preventing the stay from moving within said pocket.

12. The collar according to claim 11, wherein:

said stop stitch closes said second end of said pocket adjacent said sewing edge; and a further stop stitch is formed adjacent said finished edge for substantially preventing said stay from protruding through said finished edge.

13. The collar according to claim 11, including a side opening formed at each of said two selvedges for inserting the stay into said pocket or removing the stay from said pocket.

14. The collar according to claim 11, wherein:

said knitted collar is substantially rectangular; and said finished edge is opposite said sewing edge.

15. The collar according to claim 11, wherein said stop stitch forms said second end of said pocket.

16. The collar according to claim 11, wherein said second end of said pocket is opposite said first end of said pocket.

17. The collar according to claim 12, wherein said further stop stitch extends along said finished edge.

18. The collar according to claim 12, wherein said further stop stitch extends parallel to said finished edge.

19. A shirt, comprising:

a shirt body; and a knitted collar including:

a knitted collar body having:

a sewing edge attached to said shirt body;

a finished edge; and two selvedges;

said collar body having a pocket at each of said two selvedges, said pocket having first and second ends extending approximately from said finished edge to said sewing edge, and said pocket being closed at said first end by said finished edge;

a stay disposed in said pocket of each of said two selvedges, said stay having:

a first end facing said first end of said pocket; and a second end facing said second end of said pocket; and a stop stitch formed between said first and second ends of said pocket, said stop stitch closing one of said first and second ends of said pocket for substantially preventing said stay from moving within said pocket.

20. A shirt, comprising:

a shirt body; and a knitted collar including:

a knitted collar body having:

a sewing edge attached to said shirt body;

a finished edge; and two selvedges;

said collar body having a pocket at each of said two selvedges for receiving a stay, said pocket having first and second ends extending approximately from said finished edge to said sewing edge, and said pocket being closed at said first end by said finished edge; and a stop stitch formed between said first and second ends of said pocket, said stop stitch closing one of said first and second ends of said pocket for substantially preventing the stay from moving within said pocket.

21. A method for manufacturing a knitted collar, which comprises:

knitting a collar body having a sewing edge, a finished edge, and two selvedges;

forming a pocket with a bottom closed by the finished edge at each of the two selvedges during knitting;

inserting a stay in the pocket towards the bottom of the pocket; and forming a stop stitch between the finished edge and the sewing edge.

22. The method according to claim 21, which further comprises forming the stop stitch between the stay and the sewing edge.

23. The method according to claim 21, which further comprises forming the stop stitch through the stay.

24. The method according to claim 22, which further comprises forming the stop stitch to close the pocket just after the collar body has been knitted to a length approximately equal to a length of the stay.

25. The method according to claim 21, which further comprises forming a further stop stitch adjacent the finished edge to substantially prevent the stay from protruding through the finished edge.

26. The method according to claim 21, which further comprises forming a side opening at each of the selvedges for inserting the stay into the pocket or removing the stay from the pocket.

* * * * *